United States Patent [19]

Brown

[11] Patent Number: 4,946,360

[45] Date of Patent: Aug. 7, 1990

[54] FINISHING TOOL

[76] Inventor: John Brown, 1132 Spruce, Indianapolis, Ind. 46203

[21] Appl. No.: 306,886

[22] Filed: Feb. 6, 1989

[51] Int. Cl.[5] ..... B05C 17/10

[52] U.S. Cl. ..... 425/458; 15/104 S; 15/235.7; 15/235.8

[58] Field of Search ..... 425/458; 15/235.4, 235.5, 15/235.6, 235.7, 235.8, 236 R, 104 S

[56] References Cited

U.S. PATENT DOCUMENTS

| | | | |
|---|---|---|---|
| 2,800,672 | 7/1957 | Gilyan | 15/105 |
| 2,968,057 | 1/1961 | Pratt | 425/458 |
| 3,069,713 | 12/1962 | Obraske | 15/236 |
| 3,090,140 | 5/1963 | Trana | 37/143 |
| 3,341,878 | 9/1967 | Hubbard | 15/235.4 |
| 3,408,677 | 11/1968 | Yates | 15/236 R |
| 3,878,581 | 4/1975 | Perna | 15/235.7 |
| 4,496,500 | 1/1985 | Haber | 425/458 |
| 4,619,013 | 10/1086 | Yon | 15/235.8 |
| 4,631,019 | 12/1986 | House | 435/458 |
| 4,654,919 | 4/1987 | Liberman | 15/235.4 |
| 4,669,970 | 6/1987 | Perry | 425/458 |
| 4,784,598 | 11/1988 | Kranz et al. | 425/458 |

OTHER PUBLICATIONS

Magic Tools, "Corner-Pro Rubber Drywall Knife", advertisement.

*Primary Examiner*—James C. Housel

*Attorney, Agent, or Firm*—Willian Brinks Olds Hofer Gilson & Lione

[57] ABSTRACT

A finishing tool providing a smooth finish to taped coved joints or to corner joints having an angle greater than 90° defined by converging wall board surfaces is presented. The finishing tool includes a working plate and a supporting plate, each being provided with a substantially straight edge disposed transversely to the longitudinal axes of the tool. Each of the working and supporting plates is formed of resilient material to provide longitudinal and latitudinal flexural movement so as to allow the entire length of the straight edge of the working plate to engage seam sealing material applied to the corner joint and the adjacent wall board surfaces to provide a smooth continuous finish to the corner joint.

11 Claims, 1 Drawing Sheet

FINISHING TOOL

TECHNICAL FIELD

The present invention relates to tools for finishing joints in wall board surfaces and, more particularly, to a flexible tool for finishing seam sealing material applied to corner joints having an obtuse angle.

BACKGROUND ART

Modern architecture often utilizes contemporary designs incorporating non-right angles and coved or vaulted ceilings to provide an aesthetic appearance and environment. A coved ceiling is commonly defined as a ceiling formed in an arched manner at its junction with the side walls. Conventional construction methods generally require that arches or vaulted ceilings be constructed from flat wall board or panel surfaces arranged at non-right angles to the adjacent panels resulting in corners having angles greater than 90°.

During the construction of such homes or buildings, providing a coved finish to corners having non-right angles often proves troublesome and persons skilled in the art readily appreciate the great amount of skill required to achieve a smooth continuous finish to the dry wall compound applied to such corners. "Finishing operations" refers to the task of providing a smooth, continuous finish to the corner joint area after junction tape and plaster compound has been applied to secure the tape in the corner joint. Coved corners or joints may exist at the junction of two walls, at the junction of a side wall and a ceiling or possibly even at the junction of a side wall and a floor. The angles provided by these designs are greater than 90° and normally are approximately 115° to 120°.

Prior conventional tools have provided a poor solution to the problem of obtaining a smooth, continuous finish at coved corners. Conventional methods require a worker, after the corner joint has been taped, to apply plaster compound to an area adjacent the junction line of the corner (a junction line is the boundary between the two verging panel surfaces forming the corner joint) and along the outer edge of the junction tape, smooth the plaster compound over the edge of the tape and along one side of the junction line of the corner joint until a continuous smooth surface is achieved between the taped area and the adjacent panel surfaces, and then apply plaster compound to the opposite panel surface adjacent the junction line and repeat the smoothing process. Oftentimes, as the worker is attempting to smooth and feather the plaster compound on one panel surface near the junction line, an edge of his finishing tool contacts the dry plaster compound previously applied and smoothed on the opposite panel surface, thereby leaving a blemish or mark in the plaster compound requiring the worker to repair or "touch-up" that area, or causing small masses of the dry plaster compound to pull or break away from the dried plaster compound, such as in the form of chips or flakes, and mix with the wet plaster compound being applied to the opposite panel surface. The presence of the dry flakes in the wet plaster compound render providing a smooth finish thereto practically impossible. This can be a reoccurring nightmare for a worker as, while working on one panel surface, he must be sure not to contact the plaster compound applied to the opposing panel surface while still providing a continuous smooth surface between the taped area and the adjacent panel surface and along the junction line of the corner.

U.S. Pat. No. 3,878,581 provides a prior tool for finishing the taping applied over joints or panels of wall board wherein the tool is adapted to conform to irregularities in the wall board construction. The tool comprises the combination of an elastomeric blade having a lining on its operative face for protection against abrasion and being cushioned against a rigid back. The elastomeric blade has a protruding part with an edge or edges parallel with the corresponding edge or edges of the rigid back member. The protruding part or extension of the elastomeric blade that is cushioned when in use provides flexibility while applying plaster compound in the finishing operation. The flexibility provided by the extension only occurs in a direction transverse to the edge of the extension or of the rigid back member and, hence, the angle of the corner for which the tool may be used is fixed by the limited flexing capability of the tool.

An alternative embodiment of the prior tool presents a double-edge corner structure capable of finishing both sides of the corner tape in one stroke. In use, this embodiment of the prior tool and its shape-conforming protruding portions yield when pressed upon the wall board surface. The fixed angle provided in the tool, which is intended to conform to the angle of the corner to be smoothed, dictates that the tool be positioned substantially transversely to the wall board surfaces while being moved therealong to provide continuous contact between the entire length of the protruding edges and the taped area and adjacent wall board surfaces. This requirement detracts from the efficiency required for such a finishing tool and renders the use of the tool impractical. Moreover, the fixed angle in which the tool is formed also dictates that the tool be used only with angles corresponding to the angle of the double-edge tool.

Another prior wall corner finishing tool is presented in U.S. Pat. No. 4,619,013 which describes a hand finishing tool for dry wall board installation consisting of a main body formed in two substantially flat sides extending radially from a common line, a manual tool gripping means pinned to the inner surface of the main body, and a tool biasing means to outwardly bias the flat sides of the main body to temporarily enlarge the angle of the tool during use. The flat sides of the main body diverge from a common line to define a dihedral configuration, preferably at a uniformly set angle, which is greater than 90°. The tool biasing means is adapted to enlarge the angle formed by the flat sides juxtaposed to one another that the sides normally define during tool use so as to aid in gaining the smooth surface effect of the ceiling material being deposited into the wall board corners. The use of this prior tool is limited to corners having an angle of 90°.

Prior attempts to provide a finishing tool which will distribute and blend the wet plaster compound and provide a smooth continuous finished surface to the taped area and the adjacent wall board surfaces in corner joints having an angle greater than 90° have been unsuccessful. Such prior tools have been mostly rigid and have lacked the flexibility and shape-conforming features to provide a smooth, continuous finished surface to a variety of angles with a minimum of strokes or passes of the tool.

DISCLOSURE OF THE INVENTION

A tool for providing a smooth finish to seam sealing material applied to taped corner joints between converging panel surfaces defining a corner is provided by this invention and includes a resilient supporting plate having a straight edge, a resilient working plate having a straight edge, and a handle means. The supporting plate is positioned adjacent the working plate so that the straight edge of the supporting plate is immediately juxtaposed and substantially parallel to the straight edge of the working plate with the working plate extending slightly beyond the straight edge of the supporting plate. The lengthwise dimensions of the straight edge of the working plate may be described as having a central portion and two outer portions, one on each side of the central portion. The supporting plate and the working plate each have a blade portion connected to an elongated handle portion with the straight edge of each being disposed on the blade portions opposite the elongated handle portions. The handle portions of the supporting plate and of the working plate are enveloped by an elastomeric covering and they collectively define a handle means for the tool. The supporting plate is preferably affixed to the working plate at a single point to allow the tool to flex longitudinally and latitudinally during use.

In use, the tool is positioned adjacent the seam sealing material (dry wall plaster compound) applied to a corner joint previously taped so that the outer portions of the straight edge of the working plate engage the wall board or panel surfaces adjacent the junction line of the corner joint and pressure is then applied at a central area of the supporting plate so as to urge the central portion of the working edge towards the junction line of the corner joint wherein the entire length of the straight edge engages the seam sealing material and distributes and feathers the seam sealing material over the taped joint and the adjacent panel surfaces as the blade portions of the tool flex latitudinally and longitudinally. The latitudinal flexural movement provided by the blade portions of the tool allows the entire length of the straight edge of the working plate to engage the plaster compound applied to the corner joint and to contact the panel surfaces adjacent the junction line of the corner joint to distribute and feather the seam sealing material thereabout to effect a smooth, continuous finish to the corner joint. The flexibility further permits the tool to be used effectively on various corners having differing angles; hence, use of the tool is not limited to a particular type of corner such as corners having right angles.

BEST MODE FOR CARRYING OUT THE INVENTION

Figure 1:
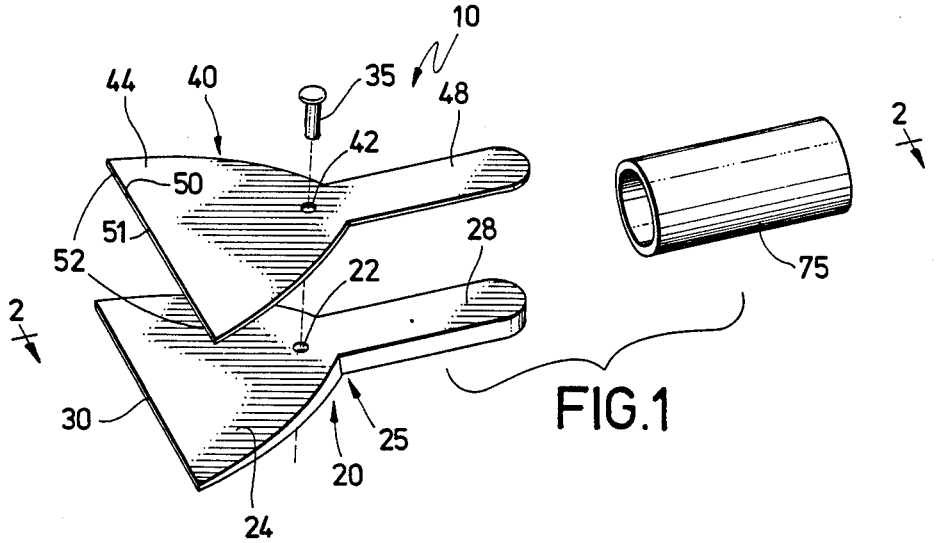
FIG. 1 is an exploded view of a finishing tool incorporating a presently preferred embodiment of the invention.
Figure 2:
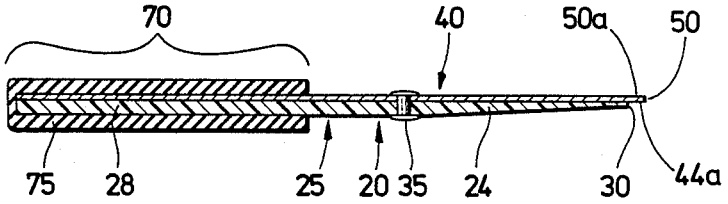
FIG. 2 is a sectional view of the finishing tool of FIG. 1 taken along plane 2—2.

A finishing tool 10 incorporating a presently preferred embodiment of this invention is illustrated in FIGS. 1 and 2 and includes a resilient supporting plate 20 having a substantially straight edge 30, a resilient working plate 40 having a substantially straight edge 50, and handle means 70. Supporting plate 20 is positioned adjacent working plate 40 so that straight edge 30 of the supporting plate 20 is immediately juxtaposed and substantially parallel to straight edge 50 of the working plate 40 while portion **44*a* of working plate 40 extends slightly beyond straight edge 30 of supporting plate 20. Supporting plate 20 and working plate 40 are preferably secured to one another at a single point by means 35 defined by a conventional rivet fastener extending through bore 42 of the working plate and bore 22** of the supporting plate.

Supporting plate 20 is provided with blade portion 24 and an elongated handle portion 28. Straight edge 30 of the supporting plate 20 is arranged on the blade portion 24 opposite the elongated handle portion 28 and substantially transversely to the longitudinal axis of the handle portion 28.

Working plate 40 is likewise provided with a blade portion 44 and an elongated handle portion 48. Straight edge 50 of the working plate 40 is arranged on blade portion 44 opposite the elongated handle portion 48 and substantially transversely to the longitudinal axis of handle portion 48. Straight edge 50 of blade portion 44 of the working plate 40 has a central portion 51 and outer portions 52 adjacent each side of central portion 51.

Handle portion 48 of the working plate 40 and handle portion 28 of the supporting plate 20 are enveloped or encapsulated by conventional means by covering 75 which is preferably formed of an elastomeric material so as to permit flexural movement of handle means 70 along its longitudinal axis. The handle portions and covering 75 collectively define handle means 70.

As more clearly shown in FIG. 2, the thickness of blade portion 24 of supporting plate 20 is gradually tapered from a point 25 adjacent the elongated handle portion 28 to straight edge 30. The thickness of blade portion 24 at straight edge 30 is preferably greater than the thickness of the working plate 40 which is uniform throughout.

Working plate 40 is preferably formed of a hard metallic material having resilient characteristics so that it tends to return to its original flat shape after flexural movement. The preferable thickness of working plate 40 is approximately 0.004 of an inch (0.1 mm).

Supporting plate 20 is preferably formed of a hard plastic material also having resilient characteristics so that it tends to return to its original flat shape after flexural movement. Supporting plate 20 is preferably greater in thickness, however, than the working plate 40 with a thickness of about 0.12 of an inch at the elongated handle portion 28. The thickness of the blade portion 24 begins to gradually taper at point 25 to straight edge 30 whereat the thickness is approximately 0.04 of an inch. Preferably, blade portion 44 and blade portion 24 have a substantially triangular shape as shown in FIG. 1 to facilitate its effective operation. It is to be appreciated that the invention claimed herein is not to be limited by the approximate thicknesses of the component plates of this finishing tool invention but is only to be limited by the scope of the claims presented below.

Figure 3:
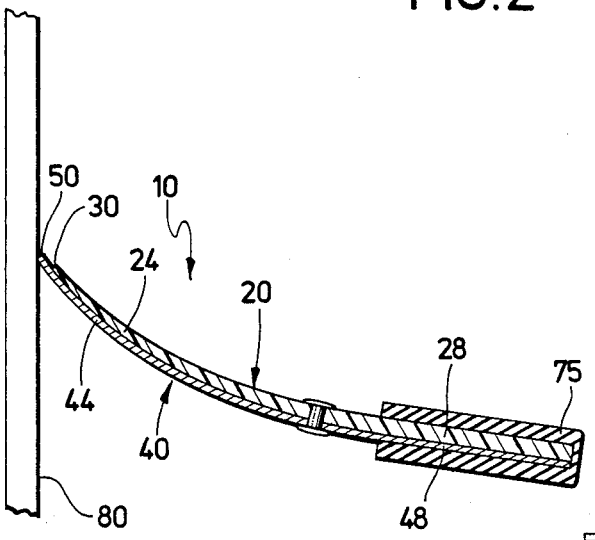
FIG. 3 is a sectional view of the finishing tool of FIG. 1 as applied to a wall board surface.
Figure 4:
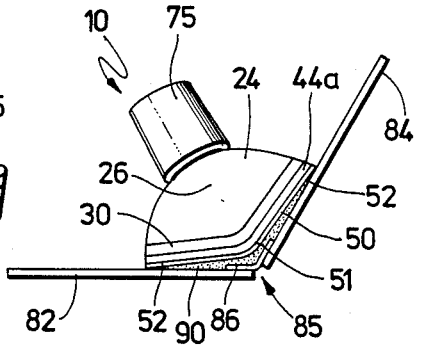
FIG. 4 is a plan view of the finishing tool of FIG. 1 as applied to a corner formed by verging wall board surfaces.

The method of use of finishing tool 10 is more clearly illustrated in FIGS. 3 and 4. In FIG. 3, finishing tool 10 is shown being pressed upon a wall board surface 80 wherein straight edge 50 of the working plate 40 engages the wall board surface 80. As is seen in FIG. 3, finishing tool 10 yields to hand pressure when the tool is pressed upon a surface at straight edge 50, wherein the working plate 40 and the supporting plate 20 each flex along their longitudinal axes. As described above, supporting plate 20 and working plate 40 are each formed of resilient material so that when tool 10 is pulled away from wall board surface 80, each tends to return to its original flat position. The longitudinal flexural movement is provided by the entire lengths of supporting plate 20 and working plate 40, including blade portions 24 and 44, and handle portions 28 and 48. As the working plate and the supporting plate each flex longitudinally and latitudinally, it is preferable that the plates be affixed to another only at a single point to permit the plates to flex freely and independently of each other. If the plates were, for example, secured to one another by adhesive applied along the lengths of the plates, the plates may be subject to undue expansion and compression forces when required to flex as a single body.

FIG. 4 shows use of the finishing tool 10 at taped portion 86 of a corner defined by verging wall board surfaces 82 and 84. When finishing tool 10 is pressed into a corner having an angle greater than 90°, and further pressure is applied to blade portion 24 of supporting plate 20 at a point 26 near the latitudinal center of the blade portion 24, central portion 51 of the straight edge 50 is biased or urged toward junction line 85 formed by the verging wall board surfaces 82 and 84 and outer portions 52 of straight edge 50 engage surfaces 82 and 84 adjacent the junction line. The resilient materials forming the plates allow the finishing tool to flex not only along its longitudinal axis, but along its latitudinal axis as well to permit central portion 51 to be urged toward the junction line of the corner joint while outer portions 52 are held in continuous engagement with wall board surfaces 82 and 84. The action of the entire length of straight edge 50 engaging the seam sealing material 90 and wall board surfaces 82 and 84 effects a smooth, feathered finish on the seam sealing material 90 applied to the taped portion 86 of the corner. Hence, the finishing tool is capable of longitudinal and latitudinal flexural movement enabling the tool to provide a smooth finish to the seam sealing material applied to the taped corner joint. The angle of the corner joint formed by verging wall board surfaces 82 and 84 is preferably approximately 120°. Such corner joints are commonly used in bay windows, vaulted ceilings, and the like.

The ability of the finishing tool to flex latitudinally and longitudinally allows one to use the finishing tool effectively in a variety of finishing operations involving angles of varying degree. The effectiveness of the finishing tool has been found by the inventor to be greatest when used in corners having angles greater than 110°.

Working plate 40 is formed preferably of hard, metallic material as described above to provide durability and resistance to surface scratches or blemishes to the working plate while at the same time providing a smooth surface essential to providing a smooth finish to the plaster compound. After periods of use, however, straight edge 50 and an area **50*a* (FIG. 2) of blade portion 44 immediately adjacent the straight edge 50 may develop nicks or burrs in their surfaces. Any such blemishes must be removed as they leave corresponding blemishes or marks in the finish of the plaster compound applied to the corner joint. Accordingly, straight edge 50 and the area 50*a* must be finely sanded periodically by conventional sanding means to remove any such nicks or burrs in the surfaces thereof and maintain a smooth surface. The periodic sanding of straight edge 50 and blade portion 44 gradually shortens the longitudinal length of working plate 40 over time which decreases portion 44*a* of blade portion 44 of the working plate extending beyond straight edge 30 of the supporting plate 20. If portion 44*a* becomes too thin, straight edge 30 of the supporting plate 20 contacts the seam sealing material 90 or the wall board surfaces 82 and 84 when finishing tool 10 is pressed into the corner, thereby adversely affecting the ability of the tool to provide a smooth finish to the seam sealing material. To prevent this from happening, blade portion 24 of supporting plate 20 is preferably shaven or roughly sanded by conventional means at straight edge 30 to maintain a substantially constant area at portion 44*a***.

The presently preferred embodiment of this invention further provides a method of providing a smooth, feathered finish to seam sealing material applied over a taped portion of a corner joint having an angle greater than 90° including the steps of positioning the finishing tool adjacent seam sealing material deposited at a corner joint, applying pressure to the finishing tool so as to urge the central portion 51 of straight edge 50 of the working plate toward the junction line of the corner joint and so that each outer portion 52 of straight edge 50 engages verging wall board surfaces 82 and 84 adjacent the corner joint so that the entire length of straight edge 50 is in continuous engagement with the seam sealing material and the wall board surfaces, and passing the tool along the corner joint while continuously applying pressure thereto so that the entire length of straight edge 50 distributes the seam sealing material over the corner joint and the adjacent areas of wall board surfaces 82 and 84 to cover taped portion 86 of the corner joint, thereby providing a smoothly feathered finish to the taped corner joint with only a minimum number of passes of the finishing tool.

Thus, the invention provides the methods and tool disclosed above in connection with the preferred embodiment of FIGS. 1–4. It must be understood, however, that there are other embodiments and variations of the invention which may be developed and that the invention is not limited to the preferred embodiment and best mode of operation currently understood, but is only to be limited by the scope of the following claims.

I claim:

1. A tool for providing a smooth finish to seam sealing material applied to taped corner joints defined by converging wall board surfaces comprising:

a resilient flexible working plate having at least one substantially straight edge, said straight edge having a central portion and two outer portions; and a resilient flexible supporting plate having at least one substantially straight edge;

said supporting plate being positioned adjacent said working plate so that the straight edge of the supporting plate is juxtaposed and substantially parallel to the straight edge of the working plate, the working plate extending beyond the straight edge of the supporting plate;

said working plate and said supporting plate being adapted to yield to hand pressure when the straight edge of said working plate is pressed upon said converging wall board surfaces, said plates being adapted to move flexurally longitudinally and latitudinally upon the application of said pressure to allow the central portion of the straight edge of the working plate to engage the seam sealing material applied to the taped corner joint and the outer portions of said straight edge to contact the verging wall board surfaces adjacent the corner joint substantially simultaneously so as to distribute and smoothly feather the seam sealing material about the corner joint and the adjacent surfaces to provide a smooth, continuous finish thereto;

said supporting plate being affixed to the working plate at a single location so as to permit said plates to move flexurally independently of each other.

2. The finishing tool as in claim 1 wherein said supporting plate and said working plate each comprise a blade portion connected to an elongated handle portion, said straight edges of said working plate and of said supporting plate being disposed on the blade portions opposite the handle portions, each of said straight edges being disposed substantially transversely to longitudinal axes of said handle portions, the handle portions of said supporting and working plates being collectively enveloped in an elastomeric covering.

3. The finishing tool as in claim 2 wherein the elastomeric covering is adapted to permit flexural movement of the handle portions along their longitudinal axes.

4. The finishing tool as in claim 2 wherein the thickness of the blade portion of the supporting plate is gradually tapered from a point adjacent the handle portion of the straight edge thereof, the thickness of the handle portion of the supporting plate is uniform and the thickness of the working plate is uniform.

5. The finishing tool as in claim 4 wherein the thickness of the supporting plate at the straight edge of the blade portion thereof is greater than the thickness of the working plate.

6. The finishing tool as in claim 4 wherein the working plate is substantially 0.004 of an inch in thickness, the handle portion of the supporting plate is substantially 0.12 of an inch in thickness, and the blade portion of the supporting plate is substantially 0.04 of an inch in thickness along the straight edge thereof.

7. The finishing tool as in claim 2 wherein each of the blade portions of the working plate and of the supporting plate has substantially triangular shape.

8. THe finishing tool as in claim 1 wherein the supporting plate is formed of hard, resilient material and the working plate is formed of hard, resilient material, said supporting plate and said working plate being resilient in that each tends to return to an original disposition after flexural movement.

9. The finishing tool as in claim 8 wherein the supporting plate is constructed of a plastic material.

10. The finishing tool as in claim 8 wherein the working plate is constructed of a metallic material.

11. The finishing tool as in claim 1 wherein the working plate is adapted to be shortened to maintain a smooth surface at the straight edge thereof, and wherein said supporting plate is also adapted to be shortened to maintain a predetermined distance between the straight edge of the working plate and the straight edge of the supporting plate.

* * * * *